US007370924B2

(12) United States Patent
Sekiguchi

(10) Patent No.: US 7,370,924 B2
(45) Date of Patent: May 13, 2008

(54) INK-DROPLET EJECTING APPARATUS

(75) Inventor: Yasuhiro Sekiguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 130 days.

(21) Appl. No.: 11/380,365

(22) Filed: Apr. 26, 2006

(65) Prior Publication Data

US 2006/0250429 A1 Nov. 9, 2006

(30) Foreign Application Priority Data

Apr. 26, 2005 (JP) ..... 2005-128109

(51) Int. Cl.
*B41J 29/38* (2006.01)

(52) U.S. Cl. ..... 347/10; 347/11

(58) Field of Classification Search ..... 347/10, 347/11

See application file for complete search history.

(56) References Cited

U.S. PATENT DOCUMENTS 5,402,159 A 3/1995 Takahashi et al.
6,257,686 B1 * 7/2001 Takahashi et al. ..... 347/10
6,386,665 B2 5/2002 Takahashi et al.
6,412,896 B2 7/2002 Takahashi et al.
6,416,149 B2 7/2002 Takahashi
6,431,674 B2 * 8/2002 Suzuki et al. ..... 347/10

FOREIGN PATENT DOCUMENTS

JP H4341853 11/1992
JP 2001301161 10/2001

* cited by examiner

*Primary Examiner*—Matthew Luu
*Assistant Examiner*—Brian J Goldberg
(74) *Attorney, Agent, or Firm*—Baker Botts L.L.P.

(57) ABSTRACT

There is disclosed an ink-droplet ejecting apparatus including a pressure chamber filled with an ink, an actuator which varies an inner volume of the pressure chamber, and a control unit which has a drive-signal generator. The drive-signal generator generates a drive signal and applies the drive signal to the actuator when a droplet of the ink is to be ejected onto a recording medium The drive signal is generated to be in one of at least one waveform including a waveform including a main pulse Pm in order to eject the ink droplet, and a stabilizing pulse Ps applied after the main pulse Pm in order not to eject an ink droplet. A pulse width Ts of the stabilizing pulse Ps is smaller than a rising time of the stabilizing pulse Ps.

10 Claims, 8 Drawing Sheets

STABILITY OF INK-DROPLET EJECTION

| | | Wm | | | | |
|---|---|---|---|---|---|---|
| | | 0.60AL | 0.86AL | 0.94AL | 1.03AL | 1.11AL |
| Ts | 0.11AL | E | E | E | E | E |
| | 0.17AL | E | E | E | E | G |
| | 0.22AL | E | E | E | G | NG |
| | 0.28AL | E | E | E | NG | NG |
| | 0.33AL | E | E | NG | NG | NG |

PREVENTION OF MIST

| | | Wm | | | | |
|---|---|---|---|---|---|---|
| | | 0.60AL | 0.73AL | 0.84AL | 0.96AL | 1.07AL |
| Ts | 0.13AL | E | E | E | E | E |
| | 0.18AL | E | E | E | E | E |
| | 0.22AL | E | E | E | E | E |
| | 0.27AL | E | E | E | E | E |
| | 0.31AL | E | E | E | E | E |

STABILITY OF INK-DROPLET EJECTION

| | | Wm | | | |
|---|---|---|---|---|---|
| | | 1.33AL | 1.40AL | 1.47AL | 1.53AL |
| Ts | 1.00AL | NG | NG | NG | NG |
| | 1.07AL | NG | NG | G | G |
| | 1.13AL | NG | E | E | G |
| | 1.20AL | NG | E | E | G |
| | 1.27AL | E | E | E | G |
| | 1.33AL | E | E | E | NG |
| | 1.40AL | E | G | G | NG |
| | 1.47AL | NG | NG | NG | NG |

PREVENTION OF MIST

| | | Wm | | | | | |
|---|---|---|---|---|---|---|---|
| | | 1.20AL | 1.27AL | 1.33AL | 1.40AL | 1.47AL | 1.53AL |
| Ts | 1.00AL | NG | NG | NG | NG | NG | NG |
| | 1.08AL | NG | NG | NG | NG | NG | NG |
| | 1.17AL | G | NG | G | NG | NG | NG |
| | 1.25AL | NG | NG | NG | NG | NG | NG |
| | 1.33AL | NG | NG | NG | NG | NG | NG |
| | 1.42AL | NG | NG | NG | NG | NG | NG |
| | 1.50AL | NG | NG | NG | NG | NG | NG |

INK-DROPLET EJECTING APPARATUS

INCORPORATION BY REFERENCE

The present application is based on Japanese Patent Application No. 2005-128109, filed on Apr. 26, 2005, the content of which is incorporated herein by reference.

BACKGROUND OF THE INVENTION

1. Field of the Invention

The invention relates to an ink-droplet ejecting apparatus of inkjet type.

2. Description of Related Art

An inkjet printer as a kind of ink-droplet ejecting apparatus includes an inkjet head having an ink passage including a pressure chamber and ending at a nozzle, and an actuator which may be of piezoelectric type. The actuator is applied with a drive signal in the form of pulses to be displaced or deformed thereby, in order to apply a pressure to ink in the pressure chamber to eject a droplet of the ink from the nozzle.

It is known to damp a pulsation remaining in the ink after the ejection of an ink droplet, or to reduce the size or volume of an ink droplet to be ejected, by adding a pulse Ps that is not for ejecting an ink droplet, to the drive pulse. More specifically, the drive pulse includes a main pulse Pm that is for ejecting an ink droplet, and the pulse Ps is applied after the main pulse Pm.

For instance, JP-A-2001-301161 (see especially FIG. 1), which is publication of a patent application by the present applicant, discloses to first apply a main pulse for ejecting an ink droplet, and then apply a non-ejection pulse or stabilizing pulse not for ejecting an ink droplet. In the technique of the above-mentioned publication, a waveform of the drive signal is changed depending on whether it is instructed to eject an ink droplet immediately before or after a specific ink droplet or dot. When such an instruction is not issued, a first waveform is employed, and when the instruction is issued, a second waveform is employed. The first waveform is such that where a time taken by a pressure wave occurring in a pressure chamber to propagate one way along an ink passage is represented by AL, a pulse width of the main pulse is 1.0AL and the stabilizing pulse having a pulse width of 0.2AL-0.3AL is applied after an interval of 0.4AL-0.6AL from the main pulse. The second waveform is such that the pulse width of the main pulse is 0.5-0.7AL and the non-ejection pulse having a pulse width of 0.2AL-0.3AL is applied after an interval of 2.0AL-2.2AL from the main pulse. It is noted that in the above-mentioned publication, the one-way propagation time AL is denoted by T.

SUMMARY OF THE INVENTION

The present inventor studied a comparative waveform of the drive signal as shown in FIG. 8A. In both of the waveform disclosed in the above-mentioned publication and the comparative waveform shown in FIG. 8A, a level of the voltage applied to the actuator is equal at the main pulse and at the non-ejection pulse that is applied after the main pulse. That is, in both the waveforms, energy generated at a rising edge of the stabilizing pulse and a falling edge thereof is equal to that of the main pulse. However, the timing to apply the stabilizing pulse is made not coincident with the pressure wave produced by the main pulse so that an ink droplet is not ejected upon the application of the stabilizing pulse.

The inventor made an experiment on ink-droplet ejection using the waveform shown in FIG. 8A. In the experiment, the inventor observed a phenomenon that after ejection of an intended ink droplet by application of the drive signal of the waveform, very fine ink droplets (which will be hereinafter referred to as mist) that do not land on a recording medium were produced. A result of the experiment is shown in tables of FIGS. 8B and 8C, in which a pulse width of the stabilizing pulse Ps, and an interval between a falling edge of a main pulse Pm and a rising edge of the stabilizing pulse Ps, are respectively represented by Ts and Wm. The table of FIG. 8B shows a result of evaluating stability in the ink-droplet ejection. That is, ink-droplet ejecting apparatuses where combinations of the values of Ts and Wm are different from one another were prepared as specimens, and each of the specimens was evaluated for stability of the ink-droplet ejection, namely, it was checked whether a recorded image on a recording medium includes fault such as splash, twist, and void. On the other hand, the table of FIG. 8C shows a result of evaluating how well occurrence of the mist was prevented. In each table, E, G, and NG respectively represent that the result was "Excellent", "Good", and "No Good". In the table of FIG. 8B, in each of the specimens, a value of Ts within a range $1.00AL \leqq Ts \leqq 1.47AL$ and a value of Wm within a range $1.33AL \leqq Wm \leqq 1.53AL$ are combined. On the other hand, in the table of FIG. 8C, in each of the specimens, a value of Ts within a range $1.00AL \leqq Ts \leqq 1.50AL$, and a value of Wm within a range $1\text{-}20AL \leqq Wm \leqq 1.53AL$ are combined. In each table, the pulse width Tm of the main pulse Pm was fixed at 1.00AL.

From the tables of FIGS. 8B and 8C, it is revealed that with the waveform shown in FIG. 8A with the values of Ts and Wm being within the ranges set forth above, the ink-droplet ejection is stably performed. However, with regard to the prevention of occurrence of the mist, it is revealed that with the waveform of FIG. 8A with the values of Ts and Wm being within the ranges set forth above, any of the specimens gave an excellent result.

The mist is ink droplets further smaller in size than an ink droplet that is produced upon separation of an intentionally ejected ink droplet from the ink inside the nozzle, The ink droplets or the mist do not land on the recording medium but waft to eventually adhere to a member or part inside the inkjet printer, which may lead to various kinds of faulty behaviors of the printer, or contamination of the printer with the ink. This in turn leads to problems such as degradation in the quality of an image recorded by the printer, or increase in the cost due to disposing in the printer a member for preventing the mist from intruding into the printer.

This invention has been developed in view of the above-described situations, and it is an object of the invention to provide an ink-droplet ejecting apparatus which can eject a droplet of ink in a predetermined size, with stability and without producing a mist of the ink.

To attain the above object, the invention provides an ink-droplet ejecting apparatus including a pressure chamber filled with an ink, an actuator which varies an inner volume of the pressure chamber, and a control unit which has a drive-signal generator. The drive-signal generator generates a drive signal and applies the drive signal to the actuator when a droplet of the ink is to be ejected onto a recording medium. The drive signal is generated to be in one of at least one waveform including a waveform including a main pulse Pm in order to eject the ink droplet, and a stabilizing pulse Ps applied after the main pulse Pm in order not to eject an ink droplet, A pulse width Ts of the stabilizing pulse Ps is smaller than a rising time of the stabilizing pulse Ps.

According to this apparatus where the pulse width Ts of the stabilizing pulse Ps included in the drive pulse is set to be smaller than the rising time of the pulses, the stabilizing pulse Ps has such a form that before a value of a voltage applied to the actuator as the drive signal reaches a predetermined drive voltage value, the application of the voltage is terminated. Thus, energy of the stabilizing pulse Ps is made relatively low. Hence, it can be considered that the ink droplet about to be ejected is gently separated from the ink inside the apparatus by the relatively low energy of the stabilizing pulse Ps, thereby preventing occurrence of a mist of the ink. In this way, degradation in the quality of a result of recording by the apparatus, and faulty behaviors of the apparatus due to contamination of the apparatus with the ink mist.

Preferably, the pressure chamber is included in an ink passage, and a pulse width Tm of the main pulse Pm, a pulse width Ts of the stabilizing pulse Ps, and an interval Wm between a terminal end of the main pulse Pm and an initial end of the stabilizing pulse Ps are set to be within the following ranges, where AL represents a one-way propagation time which is a time taken by a pressure wave to propagate one way along the ink passage: $0.8AL \leqq Tm \leqq 1.2AL$, $0.1AL \leqq Ts \leqq 0.3AL$, and $0.6AL \leqq Wm \leqq 1.0AL$.

It was confirmed in an experiment that occurrence of the ink mist was well prevented and the ejection of the ink droplet was highly stably performed, when the values of Tm, Ts, and Wm were set to fall within the above ranges.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described presently preferred embodiments of the invention, by referring to the accompanying drawings.

The inkjet printer includes an inkjet head 100 that is mounted in a carriage (not shown) reciprocated in a main scanning direction that will be hereinafter referred to as "the Y-axis direction". The main scanning direction is perpendicular to a feeding direction that is a direction in which a recording medium is fed, i.e., a sub scanning direction that will be hereinafter referred to as "the X-axis direction". Inks of respective colors, e.g., cyan, magenta, yellow, and black, are supplied into the inkjet head 100. Ink cartridges containing the respective color inks are detachably mounted on the carriage, or alternatively the ink cartridges are fixed in position in a mainbody of the inkjet printer, and the inks are supplied to the inkjet head 100 through respective supply pipes or the like.

Figure 1:
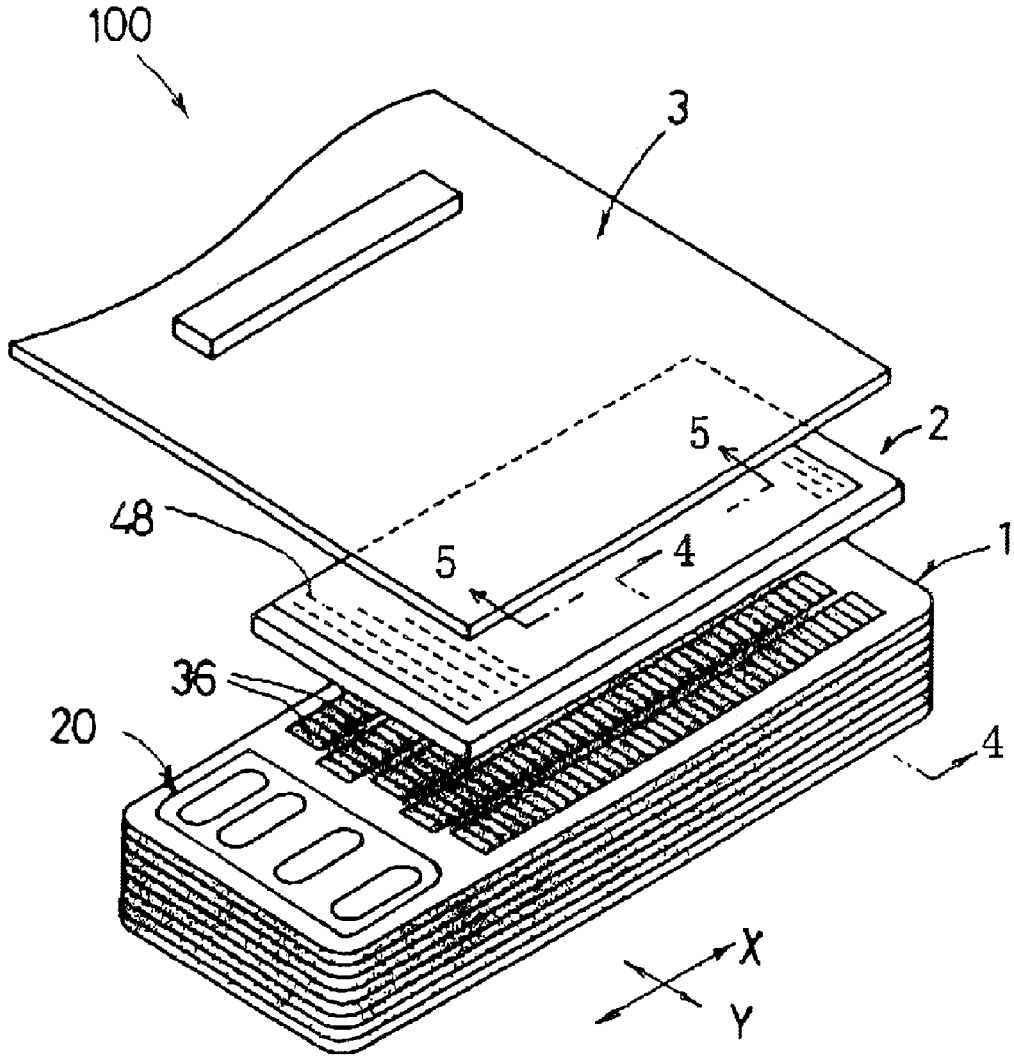
FIG. 1 is a perspective view of an inkjet head used in an ink-droplet ejecting apparatus according to one embodiment of the invention.

As shown in FIG. 1, the inkjet head 100 includes a cavity unit 1 formed of a plurality of metallic plates, and a planar piezoelectric actuator unit 2. The cavity unit 1 and the actuator unit 2 are bonded to each other. A flexible flat cable 3 (shown in FIGS. 3 and 4) is superposed on and bonded to an upper or back surface of the planar piezoelectric actuator unit 2, in order to establish connection with an external device. A plurality of nozzles 4 are formed in the cavity unit 1 to open in a lower or front surface of the cavity unit 1, so that droplets of the inks are ejected downward.

Figure 2:
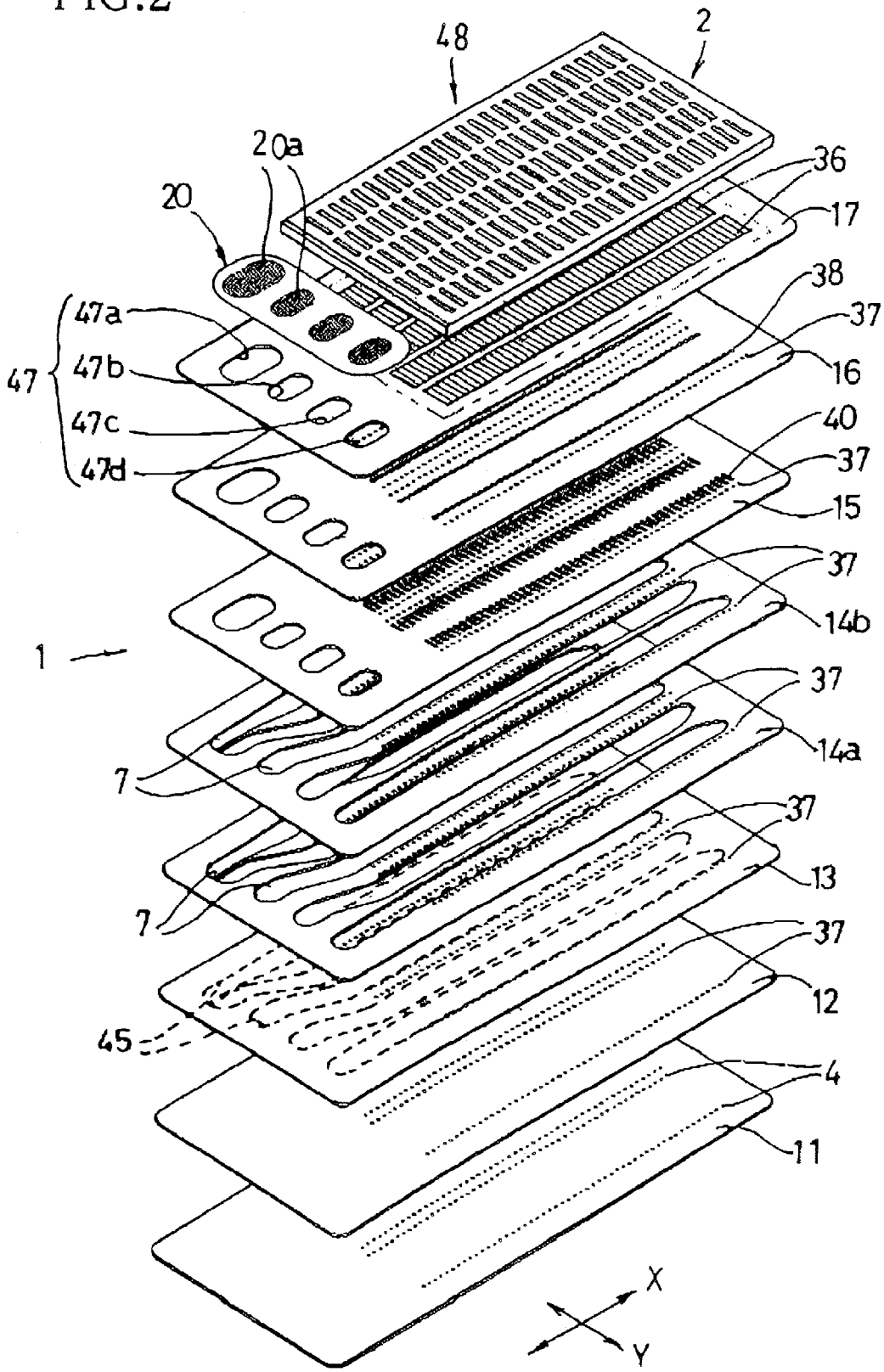
FIG. 2 is an exploded perspective view of the inkjet head.

There will be described a structure of the cavity unit 1. As shown in FIG. 2, the cavity unit 1 is formed by stacking and bonding with an adhesive eight thin plates one on another. The eight thin plates are a nozzle plate 11, a spacer plate 12, a damper plate 13, two manifold plates 14*a*) 14*b*, a supply plate 15, abase plate 16, and a cavity plate 17.

In this specific example, each of the plates 11-17 has a thickness of about 50-150 μm, and the nozzle plate 11 is made of synthetic resin such as polyimide, and the other plates 12-17 are formed of a nickel alloy steel sheet containing 42% of nickel. A plurality of the nozzles 4 for ejecting ink droplets therefrom are formed through the nozzle plate 11, and arranged at very small intervals. Each of the nozzles 4 has a diameter as small as about 25 μm. The nozzles 4 are arranged in five rows each extending along a longitudinal direction of the nozzle plate 11 that is parallel to the X-axis direction.

Figure 3:
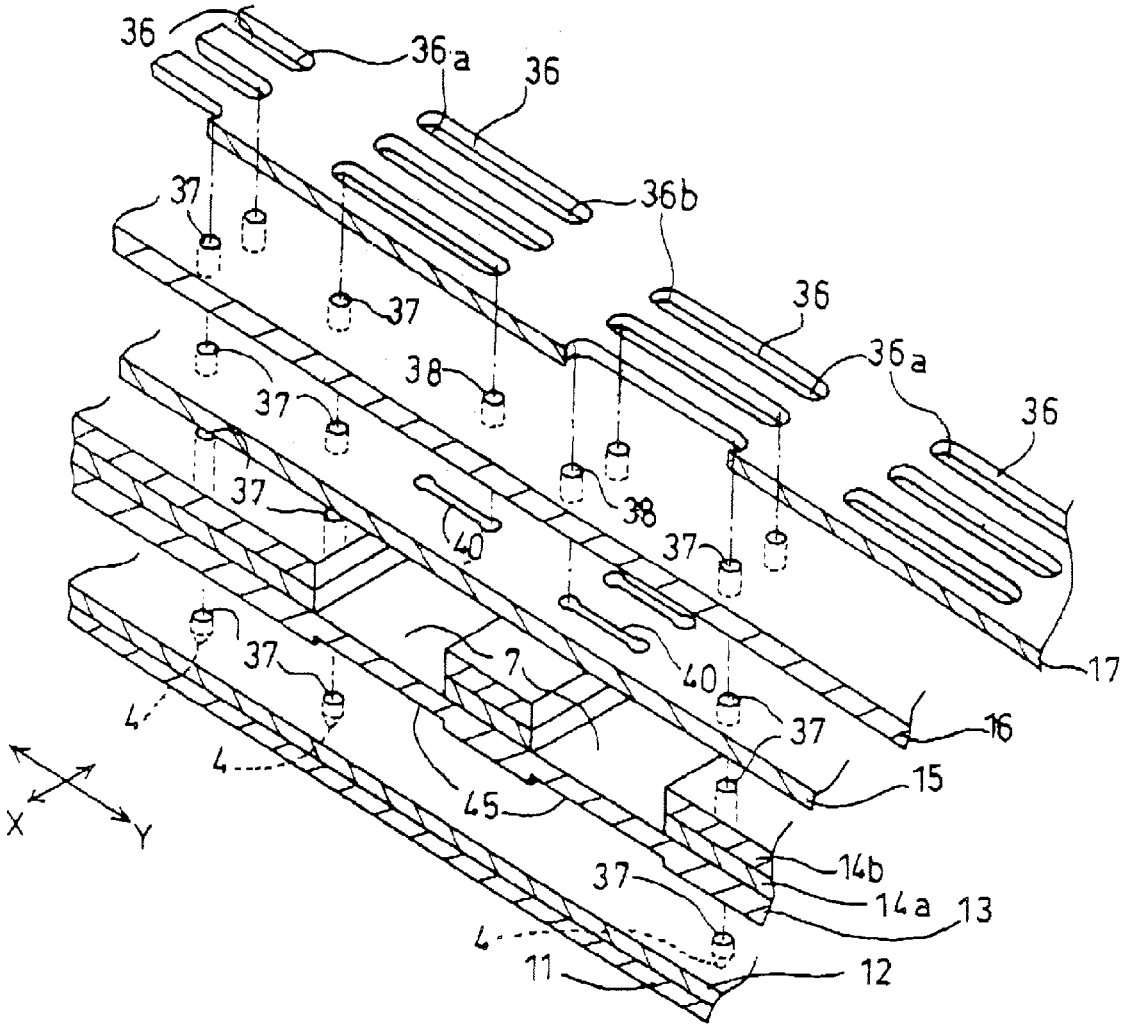
FIG. 3 is an enlarged, exploded perspective view of a cavity unit of the inkjet head.

As shown in FIG. 3, a plurality of through-holes are formed in the cavity plate 17 to serve as a plurality of pressure chambers 36. The pressure chambers are arranged in five rows each extending along a longitudinal direction of the cavity plate 17 that is parallel to the X-axis direction. In this specific example, each of the pressure chambers 36 is elongate in plan view and a longitudinal direction of the pressure chamber is parallel to the shorter sides of the cavity plate 17 that are parallel to the Y-axis direction, so that one 36*a* of two opposite longitudinal ends of the pressure chamber 36 is in communication with one of the nozzles 4, and the other longitudinal end 36*b* of the pressure chamber 36 is in communication with one of a plurality of common ink chambers 7 described later.

The longitudinal end 36*a* of the pressure chamber 36 is communicated with the nozzle 4 formed through the nozzle plate 11, via a communication hole 37 of small diameter extending through the supply plate 15, the base plate 16, the two manifold plates 14*a*, 14*b*, the damper plate 13, and the spacer plate 12.

A plurality of through-holes are formed in the base plate 16 that is immediately under the cavity plate 17, and communicated with the respective ends 36*b* of the pressure chambers 36.

A plurality of through-holes to serve as connecting passages for supplying the inks from the common ink chambers 7 (described later) to the pressure chambers 36 are formed through the supply plate 15 that is immediately under the base plate 16 Each of the connecting passages includes an inlet, an outlet, and a restricting portion therebetween. The ink in the common ink chamber 7 is introduced into the connecting passage through the inlet, then passes through the restricting portion having a smaller cross-sectional area than the inlet and outlet in order to have the highest resistance to the ink flow in the connecting passage, and then goes out of the connecting passage through the outlet that opens into the through-hole 38 that is connected to the pressure chamber 36.

Figure 4:
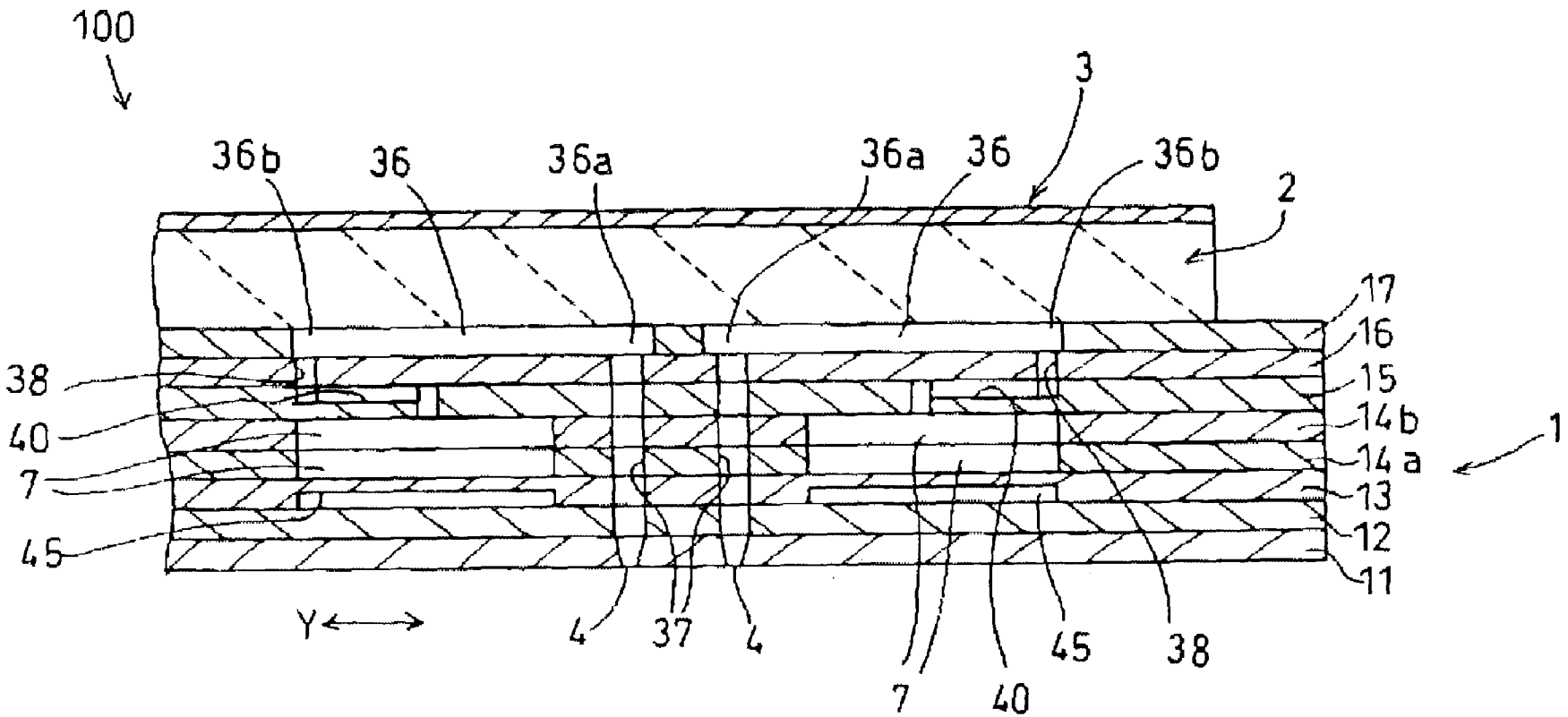
FIG. 4 is an enlarged cross-sectional view taken along line 4-4 in FIG. 1.

Five elongate through-holes to serve as common ink chambers 7 are formed through the two manifold plates 14*a*, 14*b* and extend along a longitudinal direction of the two manifold plates 14*a*, 14*b*, that is parallel to the X-axis direction. Positions of the common ink chambers 7 correspond to the rows of the nozzles 4. As shown in FIGS. 2 and 4, the two manifold plates 14*a*, 14*b* are stacked and an upper surface and a lower surface of the stack are covered with the supply plate 15 and the damper plate 13, respectively. In this way, closed common ink chambers 7 (or manifold chambers) five in total are formed. When seen in a direction of stacking of the plats 11-17, each common ink chamber 7 overlaps a part of one of rows of the pressure chambers 36, and extends along the row of the pressure chambers 36 or the nozzles 4.

As shown in FIGS. 3 and 4, on a lower surface the damper plate 13 that is immediately under the manifold plate 14*a*, there are formed five recesses to serve as damper chambers 45 not in communication with the common ink chambers 7. As shown in FIG. 2, the positions and shapes of the damper chambers 45 are coincident with those of the common ink chambers 7. The damper plate 13 is made of a metallic material capable of elastic deformation, and a thin ceiling portion over the damper chamber 45 can freely vibrate to both of the opposite sides, namely, the side of the common ink chamber 7 and the side of the damper chamber 45. Upon ejection of an ink droplet, a pressure change occurs in the corresponding pressure chamber 36, and propagates to the common ink chamber 7. At this time, the ceiling portion exhibits a damping effect, namely, elastically deforms or vibrates to absorb or attenuate the pressure change. This arrangement of the damper chambers 45 is made for reducing the crosstalk, i.e., propagation of a pressure change occurring in a pressure chamber 36 to another pressure chamber 36.

As shown in FIG. 2, four ink supply ports 47 are formed through the cavity plate 17, the base plate 16, and the supply plate 15, at one of two opposite shorter sides thereof Namely, four through-holes are formed in each of these plates 15-17. The four through-holes formed in the respective plates 15-17 are vertically aligned when the plates 15-17 are stacked, thereby forming the four ink supply ports 47. The inks in an ink supply source, i.e., the ink cartridges, are supplied through the ink supply ports 47 into end portions of the respective common ink chambers 7. The four ink supply ports are respectively denoted by reference symbols 47*a*, 47*b*, 47*c*, and 47*d*, from left to right as seen in FIG. 2.

Thus, a plurality of ink passages each beginning from one of the ink supply ports 47 and one of the nozzles 4 are formed. An ink introduced from one of the ink supply ports 47 into the corresponding common ink chamber 7 as an ink supply channel is distributed to the pressure chambers 36 via the connecting passages formed through the supply plate 15 and the through-holes 38 formed through the base plate 16, as shown in FIG. 3. As fully described later, by driving the piezoelectric actuator unit 2, the ink in each pressure chamber is selectively flown to the nozzle 4 through the communication hole 37. That is, by driving the piezoelectric actuator unit 2 as described later, a pressure is applied to the ink in the pressure chamber 36, and a pressure wave occurring in the pressure chamber 36 propagates to the nozzle 4 through the communication hole 37, thereby ejecting a droplet of the ink.

In the present embodiment, as shown in FIG. 2, the number of the supply ports 47 are four while the number of the common ink chambers 7 are five. That is, one 47*a* of the ink supply ports 47 is connected to two common ink chambers 7, 7. To the ink supply port 47*a* is supplied the black ink that is most frequently used in the four color inks. To the other ink supply ports 47*b*, 47*c*, and 47*d*, the yellow, magenta, and cyan inks are respectively supplied. A filter member 20 (shown in FIG. 1) having four filtering portions 20*a* is attached, with an adhesive or otherwise, to the cavity unit 1 such that the filtering portions 20*a* respectively cover the ink supply ports 47*a*, 47*b*, 47*c*, and 47*d*.

Figure 5:
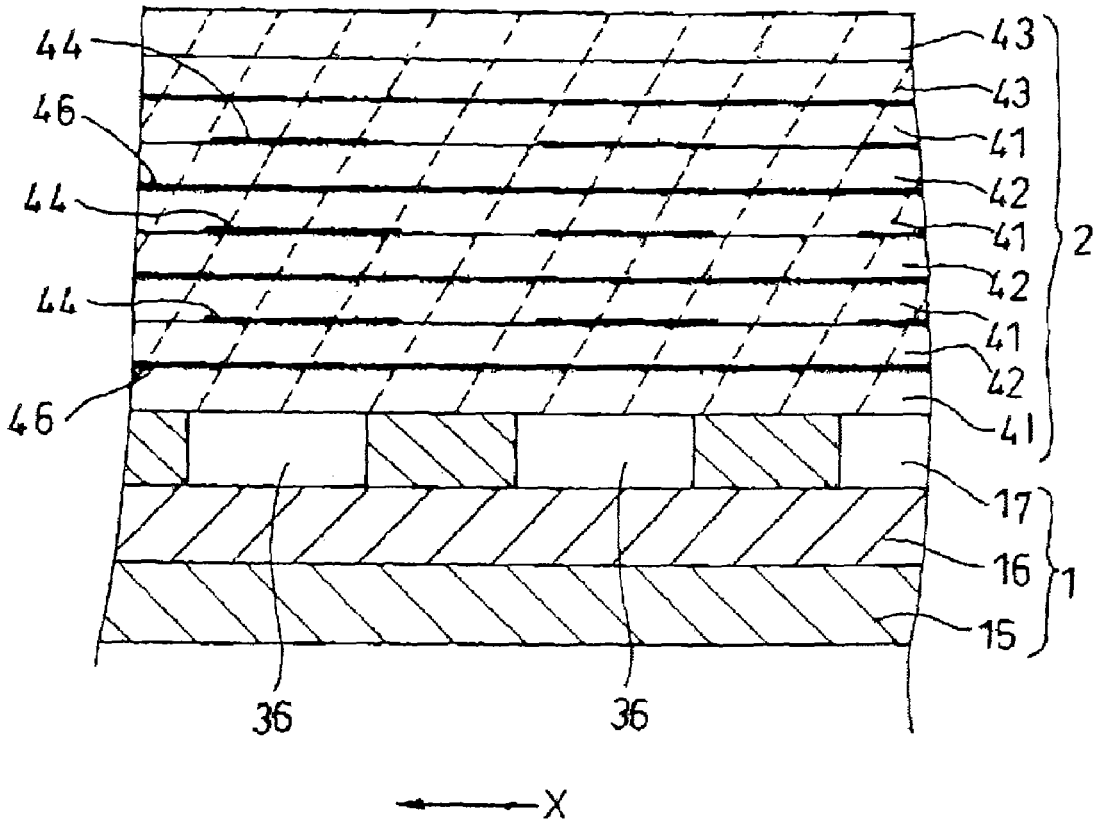
FIG. 5 is an enlarged cross-sectional view taken along line 5-5 in FIG. 1.

There will be described a structure of the piezoelectric actuator unit 2, which is similar to that disclosed in JP-A-4-341853, for instance. That is, as shown in FIG. 5, a plurality of piezoelectric sheets 41-43 each having a thickness of about 30 μm are stacked such that each even-numbered piezoelectric sheets 42 as counted from the bottom has on its major surface or an upper surface a plurality of elongate individual electrodes 44- The individual electrodes 44 are arranged in rows each extending along a longitudinal direction of the actuator unit 2 that is parallel to the Y-axis direction, so that positions of the respective individual electrodes 44 correspond to those of the pressure chambers 36 in the cavity unit 1. Each odd-numbered piezoelectric sheets 41 as counted from the bottom has on its major surface or upper surface a plurality of common electrodes 46 each for a plurality of the pressure chambers 36. On an upper surface of a topmost one 43 of the piezoelectric sheets, there are disposed a plurality of surface electrodes 48 connected to the individual electrodes respectively positionally corresponding thereto via electrical through-holes or others, and a plurality of surface electrodes connected to the respective common electrodes via electrical through-holes or others.

As well known in the art, a high voltage is applied between the individual electrodes 44 and the common electrodes 46 to polarize a portion 49 of the piezoelectric sheets between the individual electrodes 44 and the common electrodes 46, to make the portion function as an active portion 49 or an actuator.

The cavity unit 1 and the piezoelectric actuator unit 2 prepared as described above are bonded to each other as follows. An adhesive sheet (not shown) made of ink-impervious synthetic resin is attached to a lower surface of the planar piezoelectric actuator unit 2, which surface is a major surface to be opposed to the pressure chambers 36, to cover an entirety of the lower surface. Then, the piezoelectric actuator unit 2 is positioned relative to the cavity unit 1 such that the individual electrodes 44 in the actuator unit 2 are opposed to the pressure chambers 36 in the cavity unit 1, and bonded or fixed thereto. The above-mentioned flexible flat cable 3 is superposed on and pressed against an upper surface of the piezoelectric actuator unit 2, and various wiring patterns (not shown) on the flexible flat cable 3 are electrically connected to the surface electrodes.

Figure 6:
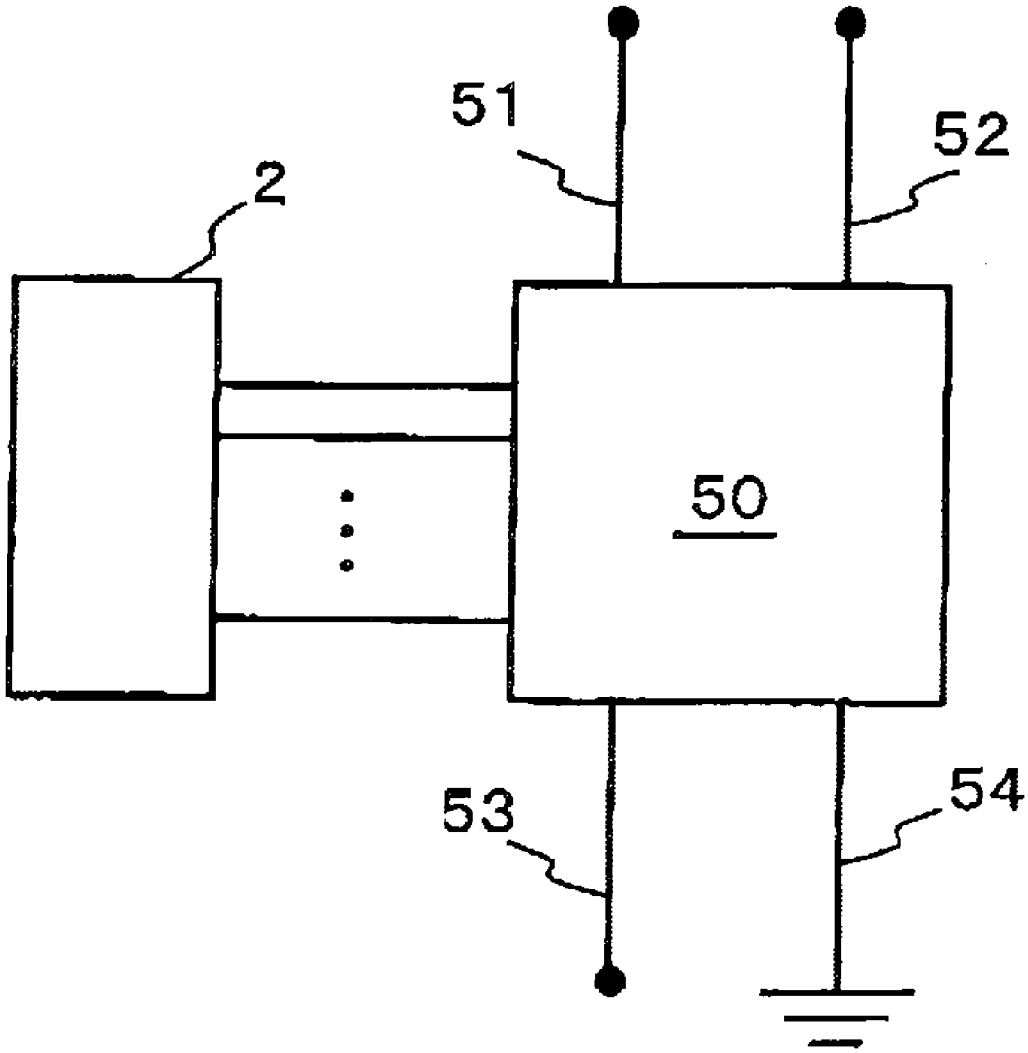
FIG. 6 is a block diagram of a control unit of the ink-droplet ejecting apparatus.

There will be described a structure of a control unit for controlling a voltage to be applied as drive voltage value to the electrodes, by referring to FIG. 6. In this embodiment, the control unit is constituted by a LSI chip 50 as a driver. The LSI chip 50 is disposed on the flexible flat cable 3. The surface electrodes corresponding to the individual electrodes 44 and the common electrodes 46 are connected to the LSI chip 50. To the LSI chip 50, there are also connected a clock line 51, a data line 52, a voltage line 53, and an earth line 54. The LSI chip 50 determines, in synchronization with clock pulses supplied from the clock line 51 and based on data on the data line 52, from which nozzle 4 an ink droplet is to be ejected, and controls the waveform of the drive pulse applied to the active portion 49 corresponding to the determined nozzle 4. The common electrodes 46 are connected to the earth line 54, and the drive signal or drive voltage value based on the voltage line 53 is selectively applied depending on whether an ink droplet is to be ejected from each nozzle 4, that is, the drive signal is applied to the individual electrodes 44 corresponding to the active portion 49 to be actuated.

Upon the driver outputting the drive signal to the individual electrodes 44 of one of the active portions 49, that active portion 49 is deformed or displaced, thereby pressurizing the ink in the pressure chamber 36 corresponding to the active portion 49, and causing a pressure wave. A component of the pressure wave which advances from the pressure chamber 36 to the nozzle 4 ejects an ink droplet from the nozzle 4.

In the inkjet printer including the thus constructed inkjet head 100, the present inventor studied a waveform of the drive signal including a non-ejection pulse of high energy or pressure, as described above in the part of "SUMMARY OF THE INVENTION". When such a waveform is employed, a mist occurs upon ejection of an ink droplet. This phenomenon can be explained as follows. That is, application of the non-ejection pulse of high energy or pressure contributes to stabilize the ejection of the ink droplet but produces smaller ink droplets, i.e., the mist, when the ink droplet separates from the ink in the nozzle 4.

Figures 7A, 7B, 7C:
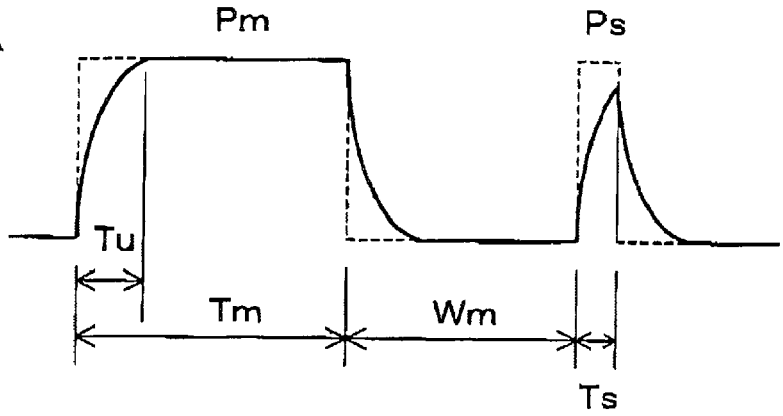
FIG. 7A is a diagram of a waveform of a drive signal applied to an actuator of the inkjet head to eject an ink droplet.
FIG. 7B is a table showing a result of an experiment conducted with respect to stability in ejecting ink droplets, by variously changing a combination of values of Ts and Wm.
FIG. 7C is a table showing a result of another experiment conducted with respect to prevention of occurrence of a mist, by variously changing a combination of values of Ts and Wm.
Figures 8A, 8B, 8C:
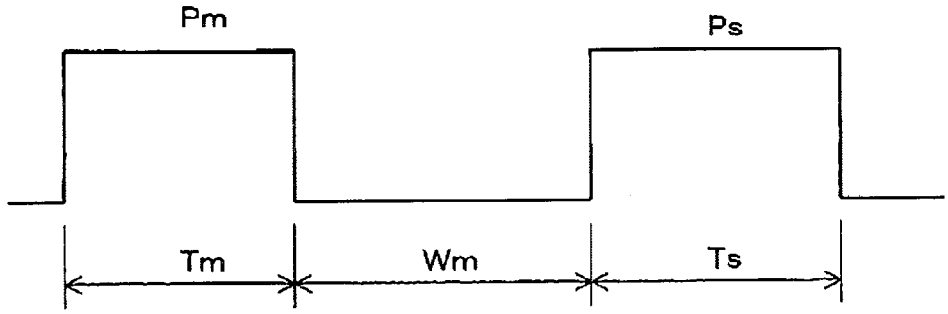
FIG. 8A is a diagram of a comparative waveform of a drive signal applied to an actuator of an inkjet head to eject an ink droplet.
FIG. 8B is a table showing a result of an experiment conducted with respect to stability in ejecting ink droplets, by variously changing a combination of values of Ts and Wm, with the comparative waveform.
FIG. 8C is a table showing a result of another experiment conducted with respect to prevention of occurrence of a mist, by variously changing a combination of values of Ts and Wm, with the comparative waveform.

Thus, according to the present embodiment, a waveform including a non-ejection or stabilizing pulse Ps of extremely low energy is employed, as shown in FIG. 7A. Like the conventional waveform, this waveform is formed of two pulses, namely, a main pulse Pm and a stabilizing pulse Ps. However, a pulse width of the stabilizing pulse Ps is extremely small, in order that the stabilizing pulse Ps takes a generally triangular shape. The shape of the stabilizing pulse Ps will be described later. Like the conventional waveform, a pulse width of the main pulse Pm is coincident with a one-way propagation time AL which is a time taken by a pressure wave to propagate one way along the ink passage, in order to eject an ink droplet with high energy efficiency. That is, Tm=1.00AL An interval Wm between a terminal end of the main pulse Pm and an initial end of the stabilizing pulse Ps is set to be smaller than the one-way propagation time AL, that is, Wm<AL.

In this embodiment, the driver controls the voltage applied to the individual electrodes 44 such that the application of the voltage to the individual electrodes 44 is stopped upon rising of the voltage of the drive signal, and applies the voltage to the individual electrodes 44 upon falling of the voltage of the drive signal. That is, the voltage is applied to the individual electrodes 44 in a waveform inverse to that of FIG. 7A Hence, during a waiting period before the ink-droplet ejection is implemented, a positive voltage is applied to all the individual electrodes 44 while the common electrodes 46 are grounded, so that all the active portions 49 disposed therebetween are expanded to decrease the inner volume of all the pressure chambers 36. Upon stopping application of the voltage in a direction of stacking of the piezoelectric sheets 41-43, to individual electrodes 44 corresponding to one of the pressure chambers 36 from which the ink is to be ejected in the form of a droplet, the corresponding active portion 49 restores to its contracted state to increase the inner volume of the pressure chamber 36. Thus, the ink pressure in the pressure chamber 36 becomes negative. At a timing when the pressure of the pressure wave inverts to be positive, the voltage is again applied to the individual electrodes 44, so that a pressure produced by expansion of the active portion 49 is added to the pressure of the pressure wave inverted to be positive, thereby ejecting an ink droplet from the nozzle 4.

The way of ejecting an ink droplet may be inversely modified such that a voltage is applied to a drive electrode to increase the inner volume of the pressure chamber to generate a pressure wave, and application of the voltage is stopped at the timing when the pressure of the pressure wave inverts from negative to positive, to decrease the inner volume of the pressure chamber to eject the ink droplet, as disclosed in JP-A-2001-301161.

The time the pressure wave takes from its generation to turn positive is determined by a one-way propagation time AL that is a time the pressure wave takes to propagate one way through each ink passage extending to one of the nozzles 4 and including the pressure chamber 36, the communication hole 37, and the through-hole 38. The one-way propagation time AL is determined by various factors including not only the natural vibration frequency of the ink and the length of the ink passage, but also a resistance of the ink passage to the ink flow and a rigidity of each of the plates defining the ink passages.

There will be described the shape of the stabilizing pulse Ps that is generally rectangular. The pulses of the drive signal such as the stabilizing pulse Ps and the main pulse Pm are applied between the individual electrodes 44 and the common electrodes 46 opposed to each other via the piezoelectric sheets or layers, so that the piezoelectric sheets or layers serve as a condenser. Further, the path or circuit from the driver outputting the pulses of the drive signal to the individual electrodes 44 has a resistance Hence, when the driver outputs a drive signal having a square waveform, an integrating circuit is formed by the condenser and the resistance, thereby causing a rounding or a lag at each rising edge and falling edge in the waveform, at the individual electrode 44. That is, the drive voltage value rises and falls with a slope, or the rising edge and falling edge of the waveform is not straight.

Hence, strictly, the waveform of the drive signal applied in a manner as indicated by broken line in FIG. 7A actually takes a waveform indicated by solid line at the individual electrode 44. Each pulse takes a time Tu (which may be referred to as "rising time") to reach a predetermined drive voltage value from initiation of application thereof, and takes a time to return to the original or initial value, which is zero in this specific example, from termination of the application. The time Tu taken to raise the voltage applied to the individual electrode 44 up to the predetermined drive voltage value and the time taken to lower the applied voltage back to the initial value are determined depending on the values of the condenser and the resistance of the piezoelectric actuator 2 as mentioned above. In this specific embodiment, the rising time Tu is about 1.8 μsec.

In this invention, the pulse width Ts of the stabilizing pulse Ps is set to be smaller than the rising time Tu, thereby making the shape of the stabilizing pulse Ps generally rectangular, that is, the application of the voltage to the individual electrode 44 is terminated before the voltage reaches the predetermined drive voltage value. However, by definition, the term "pulse width" refers to a time from a first time point when the applied voltage reaches 50% of the drive voltage value at a rising edge of a pulse, to a second time point when the applied voltage lowers down to 50% of the drive voltage value at a falling edge of the pulse, and the term "rising time Tu" refers to a time from a third time point when the applied voltage reaches 10% of the drive voltage value at a rising edge of a pulse, to a fourth time point when the applied voltage reaches 90% of the applied voltage, at a rising edge of a pulse. However, the time periods Tm and Tu are roughly and not strictly presented.

In this way, the stabilizing pulse Ps applied after the main pulse Pm is set to have a generally rectangular shape, in other words, to apply relatively low energy or pressure to the ink in the pressure chamber 36. The relatively low energy desirably damps the pressure wave produced by the main pulse Pm and remaining in the ink, but does not cause occurrence of the mist. In view of this, an experiment was conducted to optimize the pulse width Ts and the interval Wm, namely, to make the pulse width Ts and the interval Wm satisfy this condition.

A result of the experiment is shown in FIGS. 7B and 7C. The pulse width Tm of the main pulse Pm is fixed to 1.00AL, and a plurality of values are prepared for each of the pulse width Ts of the stabilizing pulse Ps, and the interval Wm between the main pulse Pm and the stabilizing pulse Ps. Ejection of an ink droplet was performed for each combination of the values of Ts and Wm, and observed. FIG. 7B shows a result of evaluation of the stability of the ink-droplet ejection for each combination, namely, a result of determination on whether a result of the recording on a recording medium includes defects such as splash, twist, void, or the like. FIG. 7C shows a result of evaluation on whether occurrence of the mist is excellently prevented. In each evaluation, E (excellent) represents that the result was excellent, NG (no good) represents that the result was bad, and G (good) represents the result was good, that is, between E and NG.

As shown in FIG. 7C, in each of the cases where the values of the pulse width Ts and the interval Wm are within the following ranges, respectively, occurrence of a mist was excellently prevented:

$$0.13AL \leqq Ts \leqq 0.31AL, \text{ and } 0.60AL \leqq Wm \leqq 1.07AL.$$

In these cases, since the rising time Tu is about 1.8 μsec, and the one-way propagation time AL is about 5.0 μsec, the value to which the voltage can rise at the stabilizing pulse Ps having the pulse width Ts is about 20-90% of the predetermined drive voltage value.

On the other hand, as shown in FIG. 7B, the ink-droplet ejection was observed for each of the combinations of the values of the pulse width Ts and the interval Wm that satisfy the following conditions:

$$0.11AL \leqq Ts \leqq 0.33AL, \text{ and } 0.60AL \leqq Wm \leqq 1.11AL.$$

In some cases where Ts was 0.33AL, and in some cases where Wm was 0.94AL, 1.03AL, and 1.11AL, the result was bad.

From the above results, it is found that when the values of Ts and Wm are respectively within the following ranges, occurrence of the mist is well prevented while the stability of the ink-droplet ejection is excellent: $0.1AL \leqq Ts \leqq 0.3AL$, and $0.6AL \leqq Wm \leqq 1.0AL$. Although it is not shown in FIGS. 7B and 7C, the pulse width Tm of the main pulse Pm is desirably set within a range of $0.8AL \leqq Tm \leqq 1.2AL$, in view of factors including a variation in the pulse width Ts.

From the result of FIG. 7B, it is derived that the stability of the ink-droplet ejection was excellent where the interval Wm and the pulse width Ts satisfies the following condition: $Wm+Ts \leqq 1.22AL$. It can also be said that occurrence of the ink mist was more excellently prevented while the ejection of the ink droplet was more highly stably performed, particularly when the following condition is satisfied; $Wm+Ts \leqq 1.10AL$.

By forming the waveform of the drive signal such that the values of Tm, Ts, Wm satisfy the above-described conditions, ejection of an ink droplet is stably performed, while occurrence of an ink mist can be excellently prevented.

What is claimed is:

1. An ink-droplet ejecting apparatus comprising:

a pressure chamber configured to be filled with an ink;

an actuator which varies an inner volume of the pressure chamber; and a control unit which has a drive-signal generator which generates a drive signal and applies the drive signal to the actuator when a droplet of the ink is to be ejected onto a recording medium, wherein the drive signal is generated in at least one waveform including a main pulse Pm in order to eject the ink droplet and a stabilizing pulse Ps applied after the main pulse Pm in order not to eject an ink droplet, a pulse width Ts of the stabilizing pulse Ps is less than a rising time of the stabilizing pulse Ps.

2. The apparatus according to claim 1, wherein the pressure chamber is included in an ink passage;

and wherein a pulse width Tm of the main pulse Pm, a pulse width Ts of the stabilizing pulse Ps and an interval Wm between a terminal end of the main pulse Pm and an initial end of the stabilizing pulse Ps are within the following ranges, where AL represents a one-way propagation time which is a time taken by a pressure wave to propagate one way along the ink passage: $0.8AL \leqq Tm \leqq 1.2AL$, $0.1AL \leqq Ts \leqq 0.3AL$, and $0.6AL \leqq Wm \leqq 1.0AL$.

3. The apparatus according to claim 2, wherein the interval Wm, the pulse width Ts, and the one-way propagation time AL satisfy the following relationship: $Wm+Ts \leqq 1.22AL$.

4. The apparatus according to claim 2, comprising:

a plurality of the pressure chambers;

a plurality of the actuators that are piezoelectric actuators including:

a plurality of individual electrodes;

a common electrode common to the individual electrodes; and a piezoelectric sheet sandwiched between the individual electrodes and the common electrode, such that a plurality of portions of the piezoelectric sheet corresponding to the respective individual electrodes comprise at least a part of a plurality of active portions each of which is configured to deform when a voltage is applied between the corresponding individual electrode and the common electrode to vary the inner volume of the corresponding pressure chamber; and a cavity unit having:

the pressure chambers;

a common ink chamber from which the ink is supplied to the pressure chambers to replenish the pressure chambers with the ink; and a plurality of nozzles each of which recieves the ink from a corresponding one of the pressure chambers, to be ejected therefrom as a droplet; and a plurality of the ink passages each of which extends from the common ink chamber to one of the nozzles via one of the pressure chambers, which corresponds to the nozzle.

5. The apparatus according to claim 4, further comprising a plurality of connecting passages for supplying the ink to the respective pressure chambers from the common ink chamber, each of the connecting passages including an inlet through which the ink from the common ink chamber is introduced, an outlet open on the side of the pressure chamber, and a restricting portion between the inlet and the outlet, a cross-sectional area of the restricting portion is reduced at the restricting portion so that a resistance of the connecting passage to flow of the ink is greatest at the restricting portion.

6. The apparatus according to claim 1, wherein the pressure chamber is included in an ink passage;

and wherein an interval Wm between a terminal end of the main pulse Pm and an initial end of the stabilizing pulse Ps, and a pulse width Ts of the stabilizing pulse Ps are set to satisfy the following relationship, where AL represents a one-way propagation time which is a time taken by a pressure wave to propagate one way along the ink passage: $Wm + Ts \leqq 1.22AL$.

7. The apparatus according to claim 6, comprising:

a plurality of the pressure chambers;

a plurality of the actuators that are piezoelectric actuators including:

a plurality of individual electrodes;

a common electrode common to the individual electrodes; and a piezoelectric sheet sandwiched between the individual electrodes and the common electrode, such that a plurality of portions of the piezoelectric sheet corresponding to the respective individual electrodes comprise at least a part of a plurality of active portions each of which is configured to deform when a voltage between the corresponding individual electrode and the common electrode varies, such that the inner volume of the corresponding pressure chamber varies; and a cavity unit having:

the plurality of the pressure chambers;

a common ink chamber from which the ink is supplied to the pressure chambers to replenish the pressure chambers with the ink; and a plurality of nozzles each of which recieves the ink from a corresponding one of the pressure chambers, to be ejected therefrom as a droplet; and a plurality of the ink passages each of which extends from the common ink chamber to one of the nozzles via one of the pressure chambers which corresponds to the nozzle.

8. The apparatus according to claim 1, comprising a plurality of the pressure chambers and a plurality of the actuators that are piezoelectric actuators including a plurality individual electrodes, a common electrode common to the individual electrodes, and a piezoelectric sheet sandwiched between the individual electrodes and the common electrode such that a plurality of portions of the piezoelectric sheet corresponding to the respective individual electrodes constitute at least a part of a plurality of active portions each of which is configured to deform when a voltage is applied between the corresponding individual electrode and the common electrode to vary the inner volume of the corresponding pressure chamber.

9. The apparatus according to claim 8, wherein the inner volumes of the pressure chambers of the piezoelectric actuators which correspond to the respective individual electrodes, decreases during a waiting period, and the main pulse Pm is a pulse for actuating one of the piezoelectric actuators which corresponds to one of the pressure chambers from which the droplet of the ink is desired to be ejected, such that an inner volume of that, pressure chamber from which the droplet of the ink is desired to be ejected increases and then decreases.

10. The apparatus according to claim 9, wherein the common electrode is grounded, wherein the individual electrodes have a positive voltage during the waiting period, and wherein the main pulse Pm selectively prevents and resumes the application of positive voltage to the individual electrodes.

* * * * *